United States Patent [19]

Unger

[11] Patent Number: 4,584,095

[45] Date of Patent: Apr. 22, 1986

[54] ORE FLOTATION METHOD EMPLOYING PHOSPHORODITHIO COMPOUNDS AS FROTHER ADJUVANTS

[75] Inventor: Kim N. Unger, Tucson, Ariz.

[73] Assignee: Thiotech, Inc., Tucson, Ariz.

[21] Appl. No.: 622,474

[22] Filed: Jun. 20, 1984

[51] Int. Cl.[4] ..... B03D 1/02

[52] U.S. Cl. ..... 209/166; 252/61

[58] Field of Search ..... 209/166; 252/61

[56] References Cited

U.S. PATENT DOCUMENTS

| | | | |
|---|---|---|---|
| 3,570,772 | 3/1971 | Booth et al. | 209/166 |
| 3,595,390 | 7/1971 | Booth | 209/166 |

FOREIGN PATENT DOCUMENTS

| | | | |
|---|---|---|---|
| 2389414 | 1/1979 | France | 209/166 |
| 33805 | 3/1974 | Japan | 209/166 |
| 546232 | 7/1942 | United Kingdom | 209/166 |
| 824661 | 12/1959 | United Kingdom | 209/166 |
| 527206 | 7/1977 | U.S.S.R. | 209/166 |
| 697196 | 11/1979 | U.S.S.R. | 209/166 |
| 825164 | 5/1981 | U.S.S.R. | 209/166 |

*Primary Examiner*—Bernard Nozick

*Attorney, Agent, or Firm*—Harry M. Weiss & Associates

[57] ABSTRACT

An ore dressing method for recovering metal values by froth flotation and from their ores, in which flotation of the ore is conducted in the presence of a frothing agent mixture comprising a minor amount of a phosphorodithioic compound as a synergistic adjuvant and a frother which may be an aliphatic alcohol or ketone; a terpenic oil or alcohol or phenol; or a polyalkylene or polyoxyalkylene glycol or ether.

10 Claims, No Drawings

ORE FLOTATION METHOD EMPLOYING PHOSPHORODITHIO COMPOUNDS AS FROTHER ADJUVANTS

BACKGROUND OF THE INVENTION

1. Field of the Invention

This invention relates generally to ore dressing methods and to concentration of metal values in ores by flotation. More particularly, the invention provides a new and valuable method of recovering metal values from ores, whereby flotation of a slurry of the ore is conducted in the presence of a frothing agent comprising a minor amount of a phosphorodithioic compound as synergistic adjuvant of frothing. This invention is distinct from that in co-pending application Ser. No. 622,473. The herein described invention relates to a novel application of phosphorodithio compounds as frother adjuvants in mixtures with other frothers. Co-pending application Ser. No. 622,473 employs phosphorodithio compounds as collectors in froth flotation. The distinction is that the present invention employs phosphorodithio compounds, not as collectors, but as adjuvants to frothing agents.

2. Description of the Prior Art

Flotation is a widely used method of concentrating ores. Froth flotation is a process for separating finely divided particles of valuable minerals from undesired materials with which they are associated. A pulp of the particles in water is mixed with a frothing agent and air is introduced into the mixture to give air bubbles. Particles of the minerals will become attached to the bubbles, whereas other minerals will not become so attached and remain in the pulp. As the froth is formed, it carries the mineral particles to the surface of the flotation system, and subsequent skimming results in recovery of the mineral.

The nature of the froth is often controlling in arriving at smooth and effective mineral recovery. A thin froth may not withstand separation. A copious froth may not provide selectivity. The froth structure should be strong enough to support not only fine particles, but also a heavier and coarser mineral load.

The flotation art has been well researched, and numerous materials have been found to serve as frothers: for example, aliphatic alcohols and ketones, terpenic compounds, and foam-producing surfactants such as the poly glycols and ethers. Industrially, frothers for use in ore flotation are of great importance, because even a very small improvement in the efficacy of the frothing agent can have immense commercial effect. With growing practice of tailing recycle, the cost efficiency of the frothing agent becomes increasingly significant.

SUMMARY OF THE INVENTION

Accordingly, an object of the invention is the provision of a flotation process wherein there is employed a frothing agent which achieves improved recovery of metal values at nominal cost.

Another object is the provision of a flotation method which will be useful with a great variety of sulfidic and non-sulfidic ores, including those of the precious metals. Still another object is the provision of a method which will result in concentrates of high quality. A most important object is the provision of an efficient method of recovering copper and molybdenum values from sulfide ores.

These and other objects hereinafter disclosed are provided by the invention wherein flotation of the ore is conducted in the presence of a frothing agent consisting essentially of a mixture of (I) a frother selected from the class consisting of (A) aliphatic alcohols and ketones of from 3 to 10 carbon atoms, (B) terpenic oils, alcohols and phenols and (C) polyalkylene and polyoxyalkylene glycols and ethers; and (II) a phosphorodithioic compound of the formula:

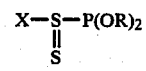

wherein X is selected from the class consisting of hydrogen, alkali metal, and the ammonium radical and R is an alkyl-substituted phenyl radical having a total of from 8 to 14 carbon atoms, from 1 to 3 alkyl substituents, and from 1 to 6 carbon atoms in each alkyl substituent, said phosphorodithioic compound comprising from about 2 to 20 percent by weight of the mixture.

The phosphorodithioic compound (II) serves as adjuvant for frothers (A), (B), and (C) in that it appears to regulate foaming rate and foam structure with respect to bubble size and strength.

Examples of frother (A) with which the phosphorodithioic compound is advantageously employed are with aliphatic alcohols such as methylisobutylcarbinol, isopropanol, n-butanol, tert-heptanol, 3-methylpentanol-3, and commercial mixtures such as those of the $C_6$ to $C_{10}$ alkanols; and ketones such as ethyl isobutyl ketone, propyl isoamyl ketone, ethyl methyl ketone, dibutyl ketone, etc.

Examples of frother (B) are terpenic materials such as the commonly employed pine oil, terpineol, creosote, etc.

Examples of frother (C) are the foam-producing, long chain derivatives of alkylene oxides such as ethylene oxide and propylene oxide and ethers thereof such as polypropylene glycol methyl ether.

Presently useful phosphorodithioic compounds (II) include the O,O-bis(alkylphenyl) phosphorodithioic acids:

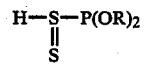

wherein R is as defined above. Some examples thereof are:

O,O-bis(2-,3-, or 4-ethylphenyl) phosphorodithioic acid

O,O-bis(2,3- or 2,4-dimethylphenyl) phosphorodithioic acid

O,O-bis(2,4,4- or 2,4,6-trimethylphenyl) phosphorodithioic acid

O,O-bis(4-isobutyl- or 4-hexylphenyl) phosphorodithioic acid

O-4-isopropylphenyl O-3-pentylphenyl phosphorodithioic acid

Presently useful alkali metal salts of the phosphorodithioic acids include the sodium, potassium, lithium or rubidium salts. They may be depicted by the general formula:

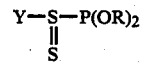

wherein Y is alkali metal and R is as defined above. Examples of such salts are:

Sodium O,O-bis(4-sec-butylphenyl) phosphorodithioate

Lithium O,O-bis(3,4,5-trimethylphenyl) phosphorodithioate

Potassium O,O-bis(2,5-diethylphenyl) phosphorodithioate

Rubidium O-3-propylphenyl O-4-ethylphenyl phosphorodithioate

The ammonium salts, e.g., ammonium O,O-bis(2,4-diethylphenyl) phosphorodithioate, are also useful.

Of particular interest, commercially, are mixtures of isomeric compounds in which the same alkyl radical is present on different positions of the phenyl residue, for example, a mixture of sodium O,O-bis(4-isopropylphenyl) phosphorodithioate and sodium O,O-bis(3-isopropylphenyl) phosphorodithioate. Such mixtures are readily obtained by using the crude isopropylphenol of commerce in preparing the phosphorodithioate. The mixtures function very well in the present process and are much less expensive than the individual compounds. Mixtures of isomeric free acids or of free acids and alkali metal or ammonium salts are also useful and often convenient.

The present invention is based on applicants' findings of improvement in quality and yield of metal which is realized by using frothers (A), (B), or (C) with a minor quantity, say as little as 2 percent by weight, of the phosphorodithioic compound. It is mixed with (A), (B) and/or (C) previous to incorporation into the flotation cycle; therefore, the mixture of frother (in many instances, a well-known commercial material) and the phosphorodithioic adjuvant is properly referred to, in its entirety, as frothing agent.

Addition of the phosphorodithioic compound to (A), (B) and/or (C) produces an enhanced froth structure which is able to support a heavy, coarse mineral load if desired. Formation of a deep, supportive froth occurs in an even manner, thereby permitting increase in the rate at which the mineral can be removed from the flotation machine. Like frothers (A), (B) and (C), the phosphorodithioic compounds have a highly polar electronegative "head" and a nonpolar hydrocarbon "tail". This similarity in chemical structure is believed to result in the following phenomena: addition of a small amount of the phosphorodithioic compound has a synergistic effect on the reduction of the air-water surface tension, so that extremely fine air bubbles can be produced by the impeller/diffuser of the flotation machine. The small bubbles improve the flotation recovery of very fine particles, while providing, also, a strong support structure for the heavier particles.

Although the invention is particularly valuable for the concentration of copper and molybdenum from sulfidic ores, the presently provided flotation method is of general utility, including concentration of such metals as silver, gold and zinc from ores in which such metals may be present at only very low levels. Frothing agents comprising a small amount of phosphorodithioic compound are effective over a wide pH range and can provide improved selectivity and substantial decrease in operating times.

The invention is further illustrated by, but not limited to, the following examples.

EXAMPLE 1

This example shows testing of sodium O,O-bis(4-isopropylphenyl) phosphorodithioate (denoted below as compound A) as an adjuvant for several commonly used frothers.

San Manuel ore (Magma Copper Company 0.660% Cu) was crushed, and 700 g of the crushed ore was mixed with 500 mls of water, 5 mg of potassium amyl xanthate as collector and sufficient lime to bring the mixture to a pH of 10.5. The mixture was ground for 7 minutes in a laboratory ball mill and the resulting pulp was transferred to a flotation cell. After addition of the frothing agent shown below, flotation was conducted for 4 minutes. Assay of the resulting concentrate gave the following results:

| Frother | Copper, % Recovery |
|---|---|
| 35 mg methylisobutylcarbinol (MIBC) | 69.7 |
| 28 mg HIBC + 7 mg compound A | 73.4 |
| 35 mg pine oil | 71.7 |
| 28 mg pine oil + 7 mg compound A | 76.6 |
| 35 mg polypropyleneglycol methyl ether, molecular wt. 1012 (PPGMe) | 74.8 |
| 28 mg PPGMe + 7 mg compound A | 77.0 |

EXAMPLE 2

This example shows the effect of O,O-bis(isopropylphenyl) phosphorodithioic acid (denoted as compound (B) below) as frothing agent constituent on the recovery of molybdenum by ore flotation.

Cuajone ore (Southern Peru Copper Company 0.042% Mo) was crushed, and 700 g of the crushed ore was mixed with 500 mls of water, 10 mg of N-ethyl O-isopropyl thionocarbamate as collector, and sufficient lime to bring the pH of the mixture to 9.9. The ore was ground in the ball mill for 6 minutes and the resulting pulp was transferred to a flotation cell. After addition of the frothing agent shown below, flotation was conducted for 4 minutes. Assay of the resulting concentrate gave the following results:

| Frother | Molybdenum, % Recovery |
|---|---|
| 40 mg methylisobutylcarbinol (MIBC) | 54.8 |
| 33 mg MIBC + 7 mg compound B | 74.8 |
| 60 mg polypropyleneglycol (PPG) mol. wt 400 | 33.2 |
| 50 mg PPG + 10 mg compound B | 61.9 |
| 40 mg pine oil | 73.8 |
| 33 mg pine oil + 7 mg compound B | 78.6 |

The herein described flotation procedures are given by way of illustration only, since any ore dressing flotation technique may be used so long as the presently provided frothing agent is employed. It is customary in the art to employ other additives or reagents in flotation, for example, there may also be used materials which serve as activators, depressants, or modifying agents. The presence or absence of such reagents and their nature will vary with ores and reaction conditions, and selection of such other additives for serving differing functions can be readily arrived at by easy experimentation.

While the invention has been particularly shown and described with reference to preferred embodiments thereof, it will be understood by those skilled in the art that the foregoing and other changes in forms and details may be made therein without departing from the spirit and scope of the invention.

What is claimed is:

1. An ore dressing method for recovering copper or molybdenum metal values from their ores by froth flotation, wherein flotation is conducted in the presence of a collector for copper or molybdenum and in the presence of a frothing agent mixture consisting essentially of (I) a frother selected from the class consisting of (A) aliphatic alcohols of from 3 to 10 carbon atoms, (B) terpenic oils, and (C) polyalkylene and polyoxyalkylene glycols and polyoxyalkylene glycol ethers; and (II) a frother adjuvant comprising a phosphorodithioic compound of the formula:

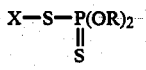

wherein X is selected from the class consisting of hydrogen, alkali metal, and the ammonium radical and R is an alkyl-substituted phenyl radical having a total of from 8 to 14 carbon atoms, from 1 to 3 alkyl substituents, and from 2 to 6 carbon atoms in each alkyl substituent, said phosphorodithioic compound comprising from about 16.7 to 20 percent by weight of the mixture and recovery of copper or molybdenum from the forth.

2. The ore dressing method defined in claim 1, further limited in that X is hydrogen.

3. The ore dressing method defined in claim 1, further limited in that X is alkali metal.

4. The ore dressing method defined in claim 1, further limited in that the frothing agent consists essentially of a mixture of an aliphatic alcohol and said phosphorodithioic compound (II).

5. The ore dressing method defined in claim 1, further limited in that the frothing agent consists essentially of a mixture of polyalkylene glycol and said phosphorodithioic compound (II).

6. The ore dressing method defined in claim 1, further limited in that the frothing agent consists essentially of a mixture of methylisobutylcarbinol and sodium O,O-bis(4-isopropylphenyl) phosphorodithioate.

7. The ore dressing method defined in claim 1, further limited in that the frothing agent consists essentially of a mixture of polypropylene glycol and O,O-bis(isopropylphenyl) phosphorothioic acid.

8. The ore dressing method defined in claim 1, further limited in that the ore contains copper.

9. The ore dressing method defined in claim 1, further limited in that the ore contains molybdenum.

10. The ore dressing method defined in claim 1, further limited in that X is an ammonium radical.

* * * * *